US005423627A

United States Patent [19]

Abercrombie et al.

[11] Patent Number: 5,423,627

[45] Date of Patent: Jun. 13, 1995

[54] LIGHT WEIGHT VAULT LID

[76] Inventors: Evan W. Abercrombie, 3807 Beach Ave., Roberts Creek, B.C., Canada, V0N 2A0; Charles H. Gould, 1075 Whitechurch St., North Vancouver, B.C., Canada, V7L 2A8

[21] Appl. No.: 274,042

[22] Filed: Jul. 12, 1994

[51] Int. Cl.[6] ..... E01F 5/00

[52] U.S. Cl. ..... 404/25; 49/463; 52/586.2; 52/592.1

[58] Field of Search ..... 49/463, 501, DIG. 2; 52/586.2, 592.1, 592.2, 807, 823, 826, 19, 20; 404/2, 25

[56] References Cited

U.S. PATENT DOCUMENTS

| | | | |
|---|---|---|---|
| 3,611,655 | 10/1971 | Loebner | 52/592.2 |
| 4,367,142 | 1/1983 | Blecher | 404/2 X |
| 4,651,494 | 3/1987 | Van Wagoner | 52/592.1 |
| 5,117,596 | 6/1992 | Leslie et al. | 52/126.6 |

*Primary Examiner*—William P. Neuder
*Attorney, Agent, or Firm*—Robert W. Jenny

[57] ABSTRACT

The lid is made up of a beam assembly and a rim assembly assembled around the beam assembly. The rib assembly is made up of a plurality of channel shaped beams assembled flange to flange. The beams are structurally interlocked to help distribute concentrated loads on the lid surface. Extendable/retractable handles are provided. The top of the lid is coated with slip resistant material. The beams are pultrusions.

3 Claims, 1 Drawing Sheet

LIGHT WEIGHT VAULT LID

BACKGROUND OF THE INVENTION

1. Field

The subject invention is in the field of static structure which will be moved occasionally, such as the lids of vaults used for underground electrical and sewer systems.

2. Prior Art

Conventional covers used on underground vaults are made of cast reinforced concrete or are made of sheet iron parts welded together or may be some combination of the two. To be strong and stiff enough to tolerate being driven over by all kinds of vehicles, including trucks and heavy mobile machinery these conventional lids are heavy and cumbersome and accordingly may be hazardous to handle, particularly if no machinery is used and even when machinery is used. The hazard and the need for machinery to reduce the hazard both add to the cost of servicing the equipment in the vault covered by the lid. Accordingly there is a long standing need for a vault lid which is considerably lighter in weight than conventional prior art lids and would be available at first and maintenance costs comparable to those for conventional lids. The objectives of the subject invention are to provide such a cover having features which facilitate and reduce the hazards of its use.

SUMMARY OF THE INVENTION

The subject invention is a lid for a vault of the type used for subsurface electrical and sewage systems. Such lids are generally rectangular in plan form and must safely bear the weight of vehicular traffic including trucks, buses, road machinery and the like.

The basic component of the subject lid is a beam having a channel shaped cross-section. A lid comprises a plurality of the beams assembled side-by-side with their closed faces forming the top of the lid. The assembly of beams is enclosed in a rim of wear and chip resistant material such as steel. To provide high ratios of strength and stiffness to weight of the lid the beams are pultrusions comprising glass fibers and epoxy plastic. The lids can be made in a wide variety of widths and lengths by cutting the beams to the desired length and using as many beams as needed to provide the desired width. Width requirements can be met more precisely by using narrower beam width. The narrow width decreases the load carrying capacity of individual beams and increases the deflection under load. This difficulty is overcome by structural interconnection of the beams along their lengths. To provide these interconnections rectangular grooves are provided in the outer faces of the flanges of the channel beams and splines sized to fit into and fill the grooves in adjacent beams are inserted between the beams. The beams and splines are adhesively bonded into an assembly. With this construction loads concentrated on one beam are shared among that beam and adjacent beams. The splines and the portions of the beams shaped to receive them are as near the edges of the flanges as feasible rather than near or centered on the neutral axes of the beams and thereby contribute as much stiffness as possible to the lid assembly relative to total cross sectional beam and spline area.

In a second embodiment of the invention the beams have a tongue and groove configuration and a filler strip is used on one of the edge beams to fill out the volume enclosed by the rim.

Extensible/rectractable handles, restraining tabs, placement devices, hinges, locks and the like are fabricated into or onto the frame.

The top surface of the lid is covered with a layer of plastic filled with material such as sand to provide a skid inhibiting surface. The invention is described in more detail below with reference to the attached drawings.

DETAILED DESCRIPTION OF THE INVENTION

Figure 1:
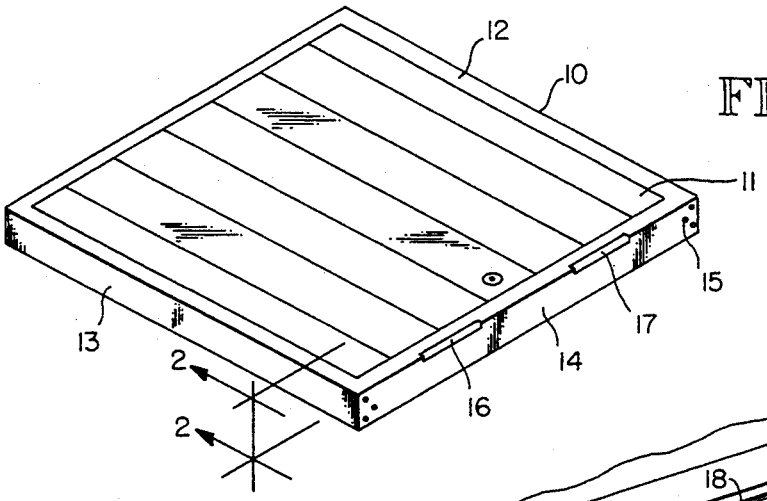
FIG. 1 is a general view of one embodiment of the subject invention.

The subject invention is a relatively light weight lid for subsurface vaults such as those used in electrical and sewage systems. Lid 10 in FIG. 1 comprises beam assembly 11 and rim assembly 12. The rim assembly comprises three part sub-assembly 13 and part 14 attached to it by at lest two fasteners, fastener 15 being typical. Handles 16 and 17 extend from and retract into spaces provided for them between the beam assembly and part 14. FIG. 1A is a view showing handle 16 and its installation in more detail. The handle is a bent rod which fits in slot 18 in part 14 and is retained in the slot, once part 14 is attached to assembly 13, by tips 19 and 20. The plastic coating on the top of the lid is not shown in this view to reveal details of the beam arrangement.

Figure 1A:
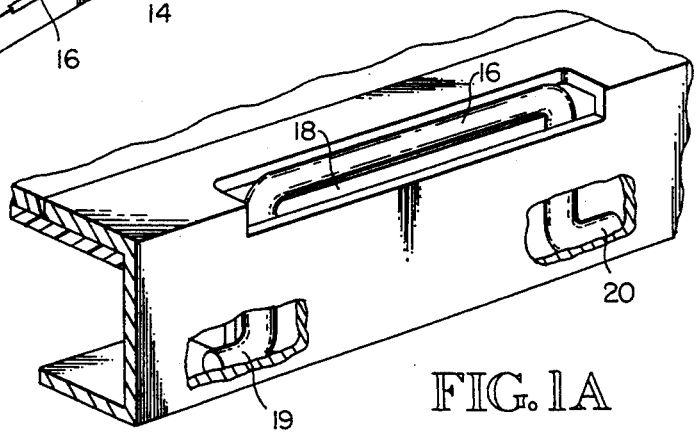
FIG. 1A illustrates a handle installation in the subject lid.
Figure 2:
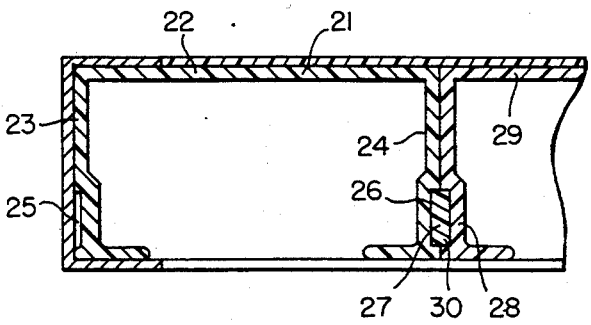
FIG. 2 is a section taken at 2—2 in FIG. 1.

FIG. 2 is a section taken at 2—2 in FIG. 1 and illustrates the cross sectional shape of the beams of the beam assembly, beam 21 being typical. Beam 21 is a channel, having a top 22 and flanges 23 and 24. Grooves 25 and 26 extend the full length of flanges 23 and 24 respectively. When two beams are placed side-by-side the grooves on adjacent flanges form a passage, passage 27 in flange 24 and flange 28 of beam 29 being typical. A spline, spline 30 being typical, is installed in each passage between two beams and all the beams and splines are held in the assembly by adhesive. The lid is completed by application of a layer of epoxy filled with sand over the tops of the beams bound by the rim.

In the preferred embodiment of the subject invention the beams are pultrusions made with techniques well known in the art. Such beams have high stiffness and strength relative to their weight and are thus well adapted to the objectives of the subject invention.

Figure 3:
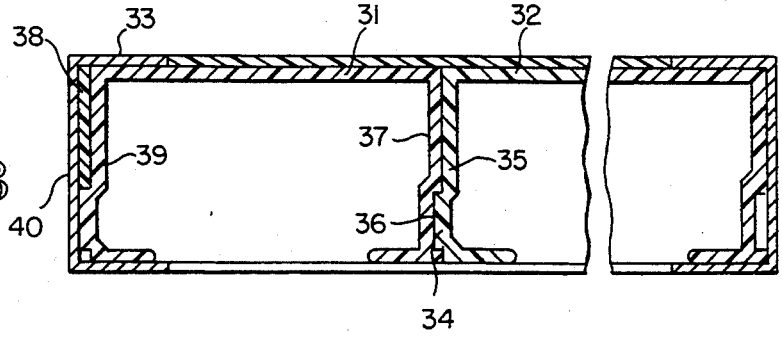
FIG. 3 is a section similar to that of FIG. 2 but illustrating a second beam cross section shape.

FIG. 3 is a sectional view similar to that of FIG. 2 but illustrating an alternate beam cross section shape. Beams 31 and 32, encircled by rim 33, are typical of the beams in this embodiment of the invention. Rib 34 on flange 35 of beam 32 fits into groove 36 in flange 37 of beam 31. This interconnection of the ribs in the grooves serves the purposes of the spline in the grooves in the configuration shown in FIG. 2. Filler strip 38 fills the space between flange 39 and rim component 40 to provide firm support for the rim component.

It is considered to be understandable from this description that the subject invention meets its objectives. The lid is considerably lighter in weight than a concrete or fabricated steel lid. Its simplicity makes it economical to manufacture. The extensive use of plastic in its manufacture provides for long term durability and low maintenance costs. The lighter weight and the handles facilitate and reduce the hazards of its use.

It is also considered to be understood that while certain embodiments of the invention are described herein, other embodiments and modifications of those described are possible within the scope of the invention which is limited only by the attached claims.

We claim:

1. A lid comprising:

a rim assembly and a beam assembly, said beam assembly having a perimeter and comprising a plurality of beams, each beam of said plurality having a top and first and second sides, said beams being assembled adjacent to each other side-by-side, said sides being configured to structurally interlock said beams such that a load in bending applied to one of said beams is distributed among said one beam and adjacent beams and said rim assembly being assembled around said perimeter.

2. The lid of claim 1 in which said beams are pultrusions.

3. The lid of claim 1 having grooves in said first and second sides and further comprising a plurality of splines, said splines engaging said grooves to structurally interlock said beams such that a load in bending applied to one of said beams is distributed among said one beam and adjacent beams.

* * * * *